US010202762B2

(12) United States Patent
Sollohub et al.

(10) Patent No.: US 10,202,762 B2
(45) Date of Patent: Feb. 12, 2019

(54) CONCEALED FASTENER WINDOW OR CURTAIN WALL ASSEMBLIES

(71) Applicant: New Jersey Institute of Technology, Newark, NJ (US)

(72) Inventors: Darius Sollohub, Glen Ridge, NJ (US); Ha Pham, Milpitas, CA (US)

(73) Assignee: New Jersey Institute of Technology, Newark, NJ (US)

( * ) Notice: Subject to any disclaimer, the term of this patent is extended or adjusted under 35 U.S.C. 154(b) by 39 days.

(21) Appl. No.: 15/301,901

(22) PCT Filed: Apr. 24, 2015

(86) PCT No.: PCT/US2015/027658
§ 371 (c)(1),
(2) Date: Oct. 4, 2016

(87) PCT Pub. No.: WO2015/164829
PCT Pub. Date: Oct. 29, 2015

(65) Prior Publication Data

US 2017/0183867 A1 Jun. 29, 2017

Related U.S. Application Data

(60) Provisional application No. 61/983,826, filed on Apr. 24, 2014.

(51) Int. Cl.
*E04B 2/96* (2006.01)
*E06B 3/54* (2006.01)
(Continued)

(52) U.S. Cl.
CPC ..... *E04B 2/965* (2013.01); *E04G 23/002* (2013.01); *E06B 3/5427* (2013.01);
(Continued)

(58) Field of Classification Search
CPC ..... E04B 2/965; E04G 23/002; E06B 9/264; E06B 3/6675; E06B 3/6621; E06B 3/5427; E06B 3/6715; E06B 2009/2643
(Continued)

(56) References Cited

U.S. PATENT DOCUMENTS 1,893,481 A * 1/1933 Adams ..... A47B 3/12 52/489.1
2,915,791 A * 12/1959 Hauf ..... E04B 1/8218 52/214
(Continued)

FOREIGN PATENT DOCUMENTS

EP 0238165 A2 9/1987
EP 1905934 A2 4/2008

OTHER PUBLICATIONS

International Search Report and Written Opinion for corresponding PCT Application No. PCT/US2015/27658, 9 pages dated Jul. 28, 2015.

*Primary Examiner* — Joshua K Ihezie
(74) *Attorney, Agent, or Firm* — Timothy X. Gibson, Esq.; Gibson & Dernier LLP

(57) ABSTRACT

Window or curtain wall assemblies and concealed window fastening assemblies are disclosed. Each window panel includes two layers of glass or other material separated by a spacing mullion, which lines the perimeter of the window panel to create a sealed chamber. The depth of the sealed chamber between the two layers is variable to accommodate either thermal requirements, vertical and horizontal structural loads, or both. The chamber reduces heat loss due to convection allowing it to outperform current double or triple glazing window walls. Each chamber can connect through tubes to allow for air or gas transfer to enhance thermal performance and create the potential for other functional and aesthetic effects. When the window panels are assembled,
(Continued)

the latching mechanism structurally unifies each panel to become a single monolithic surface that can also account for thermal expansion. Elements of the latching mechanism are arranged to allow the window or curtain wall to be assembled from the interior, leaving only caulking to be performed from the exterior. Concealing all of such elements helps eliminate the exposure of window mullions and minimizes maintenance of the window or curtain wall.

26 Claims, 24 Drawing Sheets

(51) Int. Cl.
*E04G 23/00* (2006.01)
*E06B 3/66* (2006.01)
*E06B 3/667* (2006.01)
*E06B 3/67* (2006.01)
*E06B 9/264* (2006.01)

(52) U.S. Cl.
CPC ..... *E06B 3/6621* (2013.01); *E06B 3/6675* (2013.01); *E06B 3/6715* (2013.01); *E06B 9/264* (2013.01); *E06B 2009/2643* (2013.01)

(58) Field of Classification Search
USPC .... 52/584.1, 581, 578, 127.2, 127.11, 282.1, 52/285.2, 204.1, 204.65, 204.595, 52/204.593, 204.5, 213, 235, 656.2
See application file for complete search history.

(56) References Cited

U.S. PATENT DOCUMENTS 2,962,133 A * 11/1960 Kivett ..... E04B 1/617 411/437
3,057,444 A * 10/1962 Walberg ..... E04B 2/96 52/204.597
3,267,631 A * 8/1966 Hammitt ..... E04B 1/6116 411/337
3,282,007 A * 11/1966 Campbell ..... E04B 2/7818 52/205
3,341,233 A * 9/1967 Cushman ..... E05B 65/0817 292/111
3,388,936 A * 6/1968 Gebhard ..... E06B 3/982 403/7
3,852,915 A * 12/1974 Schacht ..... E06B 3/50 49/143
3,978,629 A 9/1976 Echols, Sr.
4,497,148 A * 2/1985 Lopez ..... E04B 1/617 52/126.3
4,552,790 A * 11/1985 Francis ..... E04D 3/08 428/34
4,570,402 A * 2/1986 Johnson ..... E04B 2/76 108/64
4,756,131 A * 7/1988 Stoakes ..... E04B 2/96 52/171.3
4,912,898 A * 4/1990 Holmes ..... E04C 2/54 52/204.593
4,961,975 A * 10/1990 Bejnar ..... E06B 3/5427 156/109
5,026,581 A 6/1991 Shea, Jr.
5,036,640 A * 8/1991 Niwata ..... E06B 1/02 52/235
5,134,826 A * 8/1992 La Roche ..... E04B 2/7437 52/239
5,493,831 A * 2/1996 Jansson ..... E06B 3/5427 52/204.593
5,537,795 A * 7/1996 Dias ..... E04B 2/7425 160/135
5,600,920 A 2/1997 Roy
5,625,991 A * 5/1997 Sturrus ..... E04B 2/7425 52/281
6,598,359 B1 * 7/2003 Wulfert ..... E04B 2/88 52/167.3
7,434,364 B2 * 10/2008 MacDermott ..... E04B 2/745 52/127.11
7,954,294 B2 * 6/2011 Appleford ..... E04B 1/14 52/127.9
9,074,413 B1 * 7/2015 Sprague ..... E06B 3/5821
9,091,116 B2 * 7/2015 Saunders ..... E06B 1/366
2002/0092248 A1 * 7/2002 Westphal ..... E06B 1/6007 52/204.5
2005/0284046 A1 * 12/2005 Neal ..... E06B 1/36 52/204.5
2011/0113706 A1 * 5/2011 Krause ..... F41H 5/263 52/204.5
2011/0133940 A1 * 6/2011 Margalit ..... E06B 3/66366 340/584
2011/0296775 A1 * 12/2011 Dolby ..... E06B 3/5427 52/204.6
2013/0097790 A1 * 4/2013 Liao ..... A47L 1/02 15/88.4

* cited by examiner

CONCEALED FASTENER WINDOW OR CURTAIN WALL ASSEMBLIES

FIELD OF THE INVENTION

The present invention relates to the field of window and curtain wall assemblies; more specifically, concealed window panel and fastener latching mechanisms to connect an arrangement of such window panels.

BACKGROUND OF THE INVENTION

Unitized window wall systems have been used for skyscrapers and building structural systems. The unitized window wall system provides window panels that come with mullion frames within the panel before being installed to the building façade. The window panels include a glazing, which comes with double or triple glass panes (double glass panes with a thin film between) and is filled with a noble gas. The noble gas, typically argon or xenon, is used for thermal insulation and is installed on an exterior side of the mullion frames. The mullion frames then attach to one another by a series of clips or are fastened with bolts and nuts to the building structural system.

However, the unitized window wall system has limited space, which causes low thermal resistance and does not allow for additional layers of glazing panel. Further, the unitized window wall system is difficult to maintain and clean due to exposed mullion systems. Moreover, the unitized window wall system requires complex installation, typically off-site, leading to additional costs.

Thus, there is a need for a window or curtain wall assembly which addresses the above problems.

SUMMARY OF THE INVENTION

The present invention relates to a concealed latching mechanism for a window or curtain wall and assemblies which include a concealed latching mechanism. Each window panel of said assembly includes plural layers of glass or other material separated by one or more spacing mullions, which line the perimeter of the window panel to create a sealed chamber. The depth of the sealed chamber between the layers is variable to accommodate both thermal requirements and vertical and horizontal structural loads. The chamber reduces heat loss due to convection allowing it to outperform current double or triple glazing window walls. The chamber of each window panel is connectable to chambers of adjacent window panels through tubes or ducts to allow for air or gas transfer to enhance thermal performance and enable other functional and aesthetic effects. When the window panels are assembled, the latching mechanism structurally unifies each panel to become a single monolithic surface that also accounts for thermal expansion. Elements of the latching mechanism are arranged to allow the window or curtain wall to be assembled from the interior, leaving only caulking to be performed from the exterior. Concealing all of such elements helps eliminate the exposure of window mullions and minimizes maintenance of the window or curtain wall.

The fastener latching mechanisms disclosed herein structurally engage adjacent panels to structurally support the window or curtain wall as a whole. Embodiments of the present invention provide high thermal resistance that comes with several layers of insulated air chambers, are structurally self-sustained, provide simple on-site installation procedure, maintain flush surfaces to both the interior and exterior for aesthetic and sanitary purposes, provide capability to control and exchange gas inside of the chamber for visual effects and privacy purposes, provide flexibility and non-sequencing in the installation procedure, and provide significantly increased acoustic separation. Moreover, the fastener assemblies provide higher tolerance in absorbing energy in a seismic event, and provide a wide concealed space inside the chamber to house mechanical louvers or shading devices that can be remotely controlled while being protected from outside factors that may cause damage or degradation.

Additional merits of the present invention include aesthetically pleasing design, providing flexibility in design, and facilitating mechanical cleaning. Design flexibility allows the window panels to be any shape, as the mullions can be structured to accommodate angled window panels, including but not limited to 15 degrees, 45 degrees, 90 degrees, and 135 degrees. This allows the window panels to be shaped as triangles, parallelograms, rhombuses, or other design choices.

In accordance with one or more embodiments, a window panel fastening assembly includes a first and second mullion, each mullion having opposing mounting surfaces configured to be mounted to sheets of material, an air chamber-facing surface and an open side opposite the air chamber-facing surface, and opposing grooves disposed therein, wherein the first and second mullions are positioned with open sides facing each other, locking brackets coupled to the grooves of the first and second mullions, and a rod positioned between the locking brackets, wherein the window panel fastening assembly is operable to fasten adjacent panels to each other. The locking brackets may have a generally U-shaped cross section. At least one of the locking brackets may include bore for receiving the rod. The rod may be positioned in a space formed between the first and second mullions. The window panel fastening assembly may further include a brace positioned between the first and second mullions wherein the brace is operable to guide and secure the rod and the structural integrity between the first and second mullions. In some embodiments at least one of the locking brackets includes a threaded bore for receiving the rod, wherein the rod includes a threaded region complementary to the threaded bore, wherein advancement of the rod through the locking bracket is operable to urge the first and second locking brackets in the grooves. A backer rod may be positioned opposite the brace in a space between the two opposing mullions.

In some embodiments, at least one of the first and second locking brackets are pivotably coupled to an interior surface of one of the first and second mullions. In other embodiments both the first and second locking brackets are pivotably coupled to the first mullion.

In at least one embodiment, the window panel fastening assembly further includes a gear box positioned within the first mullion, a cable fixed at one end to one of the locking brackets, a first and second gear bar pivotably mounted to a central region of each locking bracket and coupled with a gear bar support mounted to a gear plate, wherein application of a pulling force on the cable is operable to engage the locking brackets with the grooves of the first and second mullions.

In accordance with still a further embodiment, a window panel fastening assembly is disclosed which includes a latching linear gear movably coupled to an interior surface of the first mullion and rotating gear operably coupled to a gear surface of the latching linear gear, wherein the latching linear gear is coupled to a latching bar, which is in turn coupled to a plurality of hinged plates positioned between an interior surface of the first mullion and the locking brackets, wherein the rotating gear is operable to move the latching linear gear along a longitudinal axis of the first mullion, exerting a pulling force on the latching bar, wherein movement of the latching bar is operable to pull and raise the hinged plates, which raising is operable to urge the locking brackets toward engagement with the grooves of the first and second mullion. The hinged plates are operable to fold upon each other to form a unitary latch oriented 90 degrees with respect to the first and second mullions.

In yet a further embodiment, a window panel fastening assembly is disclosed having a locking bracket housing wall including an aperture for a cable, wherein the cable is connected at one end to a first folding plate, wherein the first folding plate is hingedly coupled to a second folding plate, which in turn is hingedly connected to fixed plate coupled to a latch housing base coupled to the first mullion, and further including a block coupled to the second folding plate, wherein the first and second folding plates are positioned between an interior surface of the first mullion and the locking brackets, wherein a pulling force exerted on the cable is operable to lift the first plate to contact the block, which movement is operable to drive the locking brackets in an upward direction. The pulling force exerted on the cable is operable to lift the second folding plate upward and drive the locking brackets toward engagement with the grooves of the first and second mullions.

Window panel fastening assemblies disclosed herein may include a lateral bracing plate positioned between the first and second mullions and extending therefrom to an exterior of the window panel fastening assembly.

In accordance with still further embodiments, a window panel assembly is disclosed having a first and second sheet of material positioned in axial alignment, each sheet having a perimeter and number of sides identical to the other sheet, and a plurality of window panel fastening assemblies as disclosed above coupled along the respective perimeters of the first and second sheets, wherein the first sheet is coupled to the first mounting surface of each of the first mullions of the window fastening assemblies and wherein the second sheet is coupled to the second, opposing mounting surface of each of the first mullions, the first and second sheets and the first mullions of the plurality of window panel fastening assemblies defining an air chamber.

In yet another embodiment, a window panel assembly is disclosed having an air chamber defined by two opposing sheets of material and a plurality of window panel fastening assemblies as described herein disposed along the perimeter and between the two opposing sheets of material. Air chambers may include one or more sheets of insulation film disposed therein. Window panel assemblies disclosed herein may include at least one adjacent window panel assembly. In still further embodiments, a window wall is disclosed having a plurality of window panel assemblies as described herein, each of the plurality of window panel assemblies coupled to an adjoining window panel assembly by a concealed window panel fastening assembly.

Window wall assemblies disclosed herein may include at least one vertical track and/or horizontal track coupled to a window fastening assembly.

BRIEF DESCRIPTION OF THE DRAWINGS

So that those having ordinary skill in the art will have a better understanding of how to make and use the disclosed systems and methods, reference is made to the accompanying figures wherein.

DETAILED DESCRIPTION OF THE INVENTION

Figure 1:
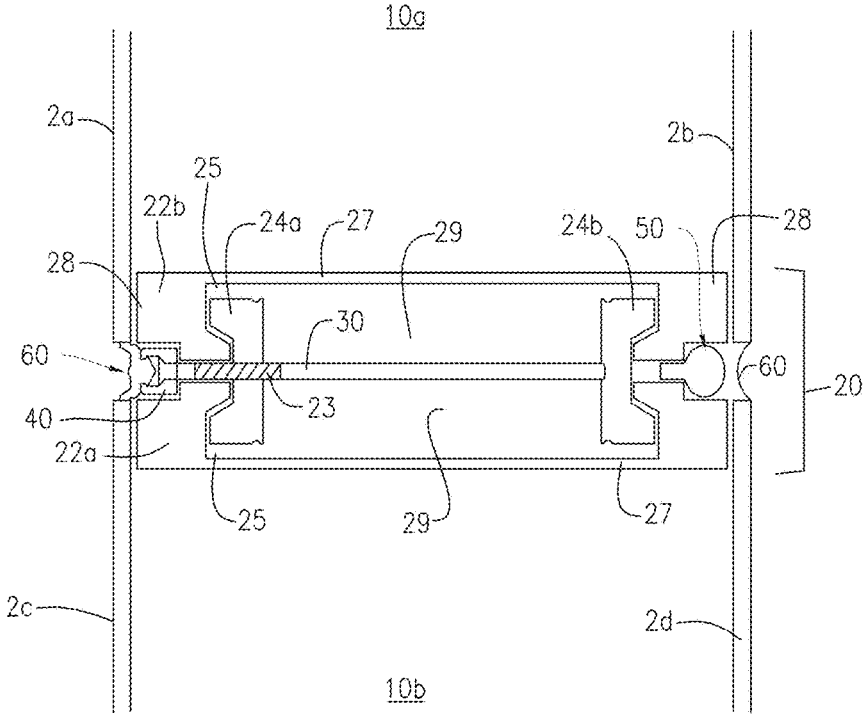
FIG. 1 is a sectional view of a window panel fastening assembly disposed between adjacent panels in accordance with an embodiment of the present invention.

The following is a detailed description of the invention provided to aid those skilled in the art in practicing the present invention. Those of ordinary skill in the art may make modifications and variations in the embodiments described herein without departing from the spirit or scope of the present invention. Unless otherwise defined, all technical and scientific terms used herein have the same meaning as commonly understood by one of ordinary skill in the art to which this invention belongs. The terminology used in the description of the invention herein is for describing particular embodiments only and is not intended to be limiting of the invention. All publications, patent applications, patents, figures and other references mentioned herein are expressly incorporated by reference in their entirety.

It will be understood that when an element is referred to as being "coupled" or "connected" to another element, it can be directly coupled or connected to the other element or intervening elements may also be present. In contrast, when an element is referred to as being "directly coupled" or "directly connected" to another element, there are no intervening elements present. Like numbers refer to like elements throughout. As used herein the term "and/or" includes any and all combinations of one or more of the associated listed items.

In addition, spatially relative terms, such as "under", "below", "lower", "over", "upper" and the like, may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is inverted, elements described as "under" or "beneath" other elements or features would then be oriented "over" the other elements or features. Thus, the exemplary term "under" can encompass both an orientation of over and under. The device may be otherwise oriented (rotated 90 degrees or at other orientations) and the spatially relative descriptors used herein interpreted accordingly.

Well-known functions or constructions may not be described in detail for brevity and/or clarity.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Concealed window panel fasteners and assemblies disclosed herein employ structural spacing mullions concealed within a panel chamber, with the fasteners operable to couple adjacent panels. This provides a structurally sound, thermally secure window or curtain wall with surfaces flush with both the interior and exterior of the window or curtain wall.

Now referring to FIG. 1 a window panel fastening assembly 20 includes mullions 22*a* and 22*b*, locking brackets 24*a* and 24*b*, and rod 30. Mullions 22*a* and 22*b* include interior grooves 25 operable to receive locking brackets 24*a* and 24*b*, opposing mounting surfaces 28, air chamber-facing surfaces 27 and open side 29 opposite the air chamber-facing surfaces 27. Mullions 22*a*, 22*b* are disposed along the perimeter of interior and exterior sheets of material 2*a* and 2*b*, respectively and coupled to the sheets at mounting surfaces 28 by a suitable attachment means such as but not limited to structural adhesive or mechanical fastener(s). The mullions 22*a*, 22*b* as installed, shown mounted to adjacent panel assemblies 10*a* and 10*b*, are operable to form and maintain a sealed chamber between the sheets 2*a* and 2*b*, and 2*c* and 2*d*, respectively, as well as provide space to install additional separate air chambers adjacent to the inside and outside sheets. The mullions 22*a*, 22*b* can be made of any material that satisfies structural and thermal requirements of a building where one embodiment of the present invention is being assembled. Suitable materials include but are not limited to a thermally efficient composite or an aluminum extrusion with an integral thermal break.

Locking brackets 24*a* and 24*b* may have any suitable cross-sectional shape suitable for securement to the mullions 22*a*, 22*b*. For purposes for illustration in one embodiment the locking brackets 24*a*, 24*b* are generally U-shaped in cross-section and are configured to engage grooves 25 of facing mullions 22*a*, 22*b*. One or both of the locking brackets may include a bore 23 for receiving the rod 30. In the embodiment shown, locking bracket 24*a* includes a bore 23. Locking brackets may be any suitable material that satisfies structural and thermal requirements of a building.

Rod 30 is configured and operable to be inserted between adjacent panel assemblies 10, 10*b* through a space formed between mullions 22*a*, 22*b* and bore 23. A brace 40 may be positioned between mullions 22*a*, 22*b* to guide and secure rod 30 and structural integrity between mullions 22*a* and 22*b*. In some embodiments bore 23 includes threading complementary to a threaded region of rod 30 so that advancement of the rod through the locking bracket 24*a* functions to urge the locking brackets 24*a* and 24*b* securely in grooves 25. A backer rod or bracket 50 may be positioned opposite brace 40. Upon installation of the rod 30, the adjacent panels 10*a* and 10*b* are secured along the perimeter including the panel fastening assembly 20. Caulk 60 may be installed to seal any gaps between the adjacent panels 10*a*, 10*b*.

The sheets 2*a*, 2*b*, 2*c* and 2*d* may be glass or other suitable material such as but not limited to aluminum or plastic. Glass material may be but is not limited to annealed, laminated, or fritted glass.

Figure 2A:
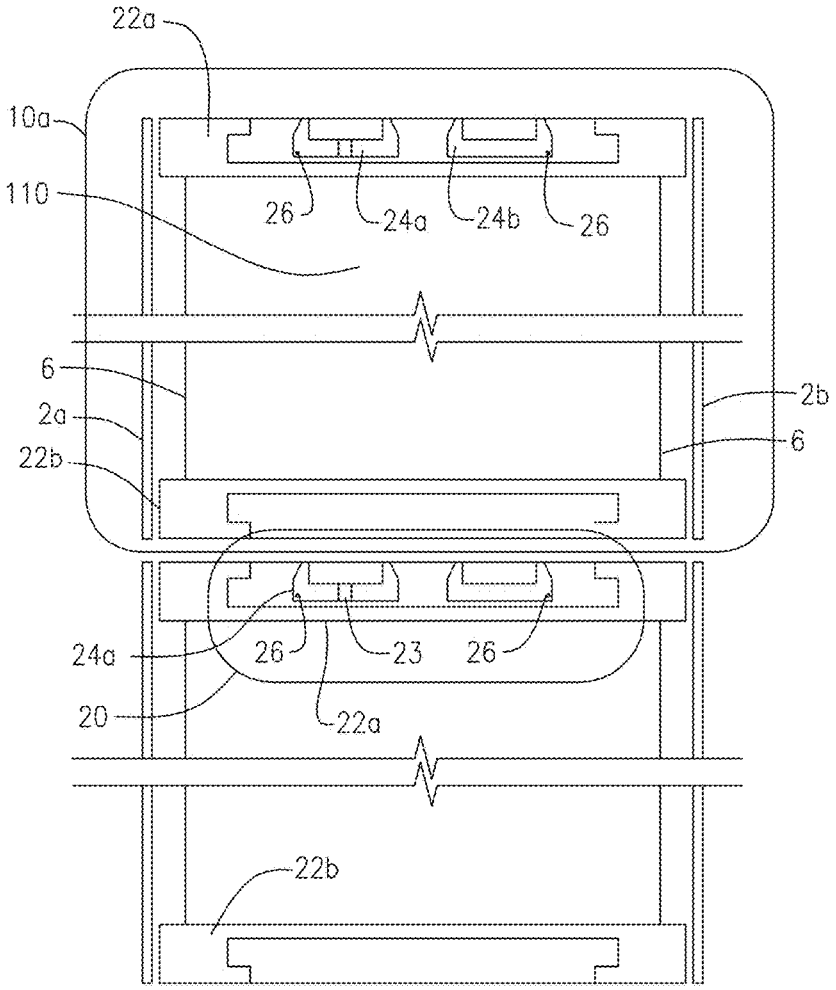
FIG. 2A is a sectional view of a window panel fastening assembly disposed between adjacent panels with locks positioned in a pre-installation position in accordance with an embodiment of the present invention.

Now referring to FIG. 2A, in one embodiment a window panel 10*a* includes insulation films in air chamber 110 to divide the chamber 110 into multiple chambers. The chamber 110 has the width of the installed spacing mullion 22*a*, 22*b*, and provides adequate space to install several layers of films to take advantage of a triple or quadruple glazing effect and to increase thermal resistance and acoustic performance of the window panel 10*a*. Such wide space between the interior and exterior glazing materials further provides sufficient room to install devices such as but not limited to shades, louvers, and other devices, which may be remotely controlled.

Figure 2B:
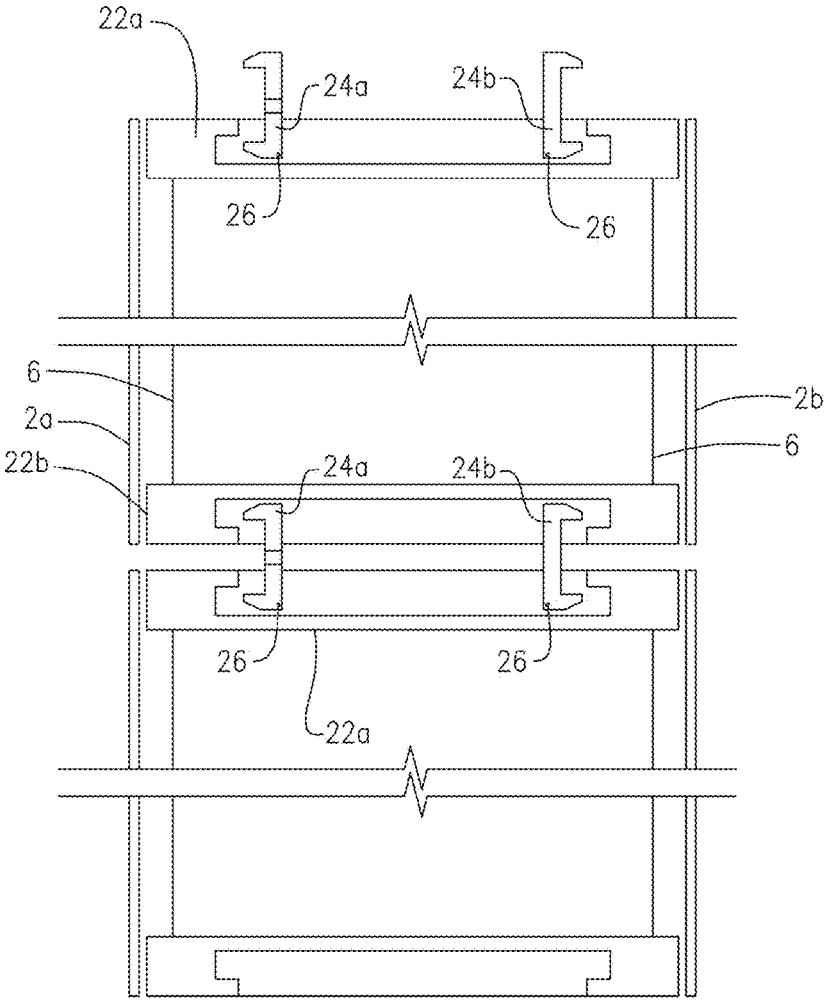
FIG. 2B is a sectional view of a window panel fastening assembly disposed between adjacent panels with locks positioned in a further pre-installation position to in accordance with an embodiment of the present invention.
Figure 2C:
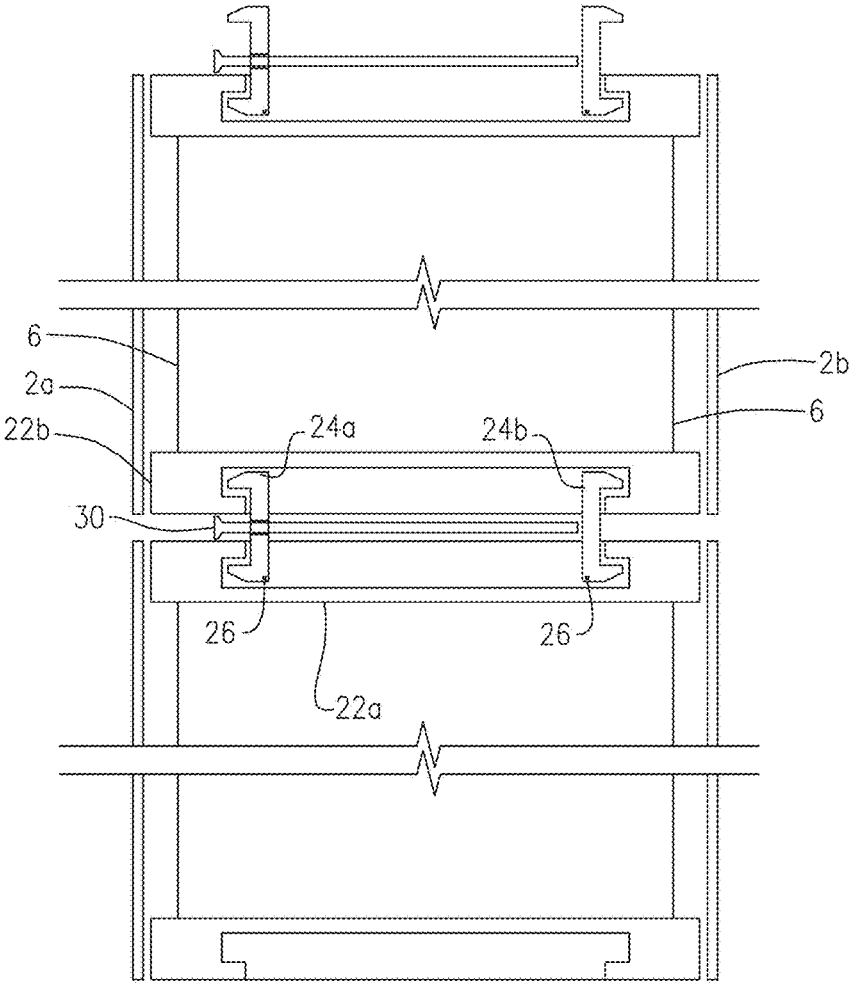
FIG. 2C is a sectional view of a window panel fastening assembly disposed between adjacent panels with locks positioned in an installation position to in accordance with an embodiment of the present invention.

Locking brackets 24*a*, 24*b* may be pivotably coupled such as at hinge 26 to an interior surface of mullion 22*a* and operable to rotate into position for installation. Prior to installation the locking brackets 24*a*, 24*b* may lay flat between grooves 25 of the mullion 22*a*. It will be apparent that in such embodiments only one of mullions 22*a*, 22*b* includes locking brackets mounted thereto, given that the opposing mullion 22*b* will be engaged by the locking brackets. Accordingly, the locking brackets can be mounted to either of the opposing mullions 22*a*, 22*b* prior to installation. In some embodiments one of each of mullions 22*a*, 22*b* may include a single locking bracket pivotably coupled thereto. With reference to FIG. 2B, locking brackets 24*a* and 24*b* are rotated into position, and with reference to FIG. 2C, installation and securement of rod 30 causes the locking brackets to engage the grooves of opposing mullions 22*a* and 22*b*, locking the adjacent panels together.

Figure 2D:
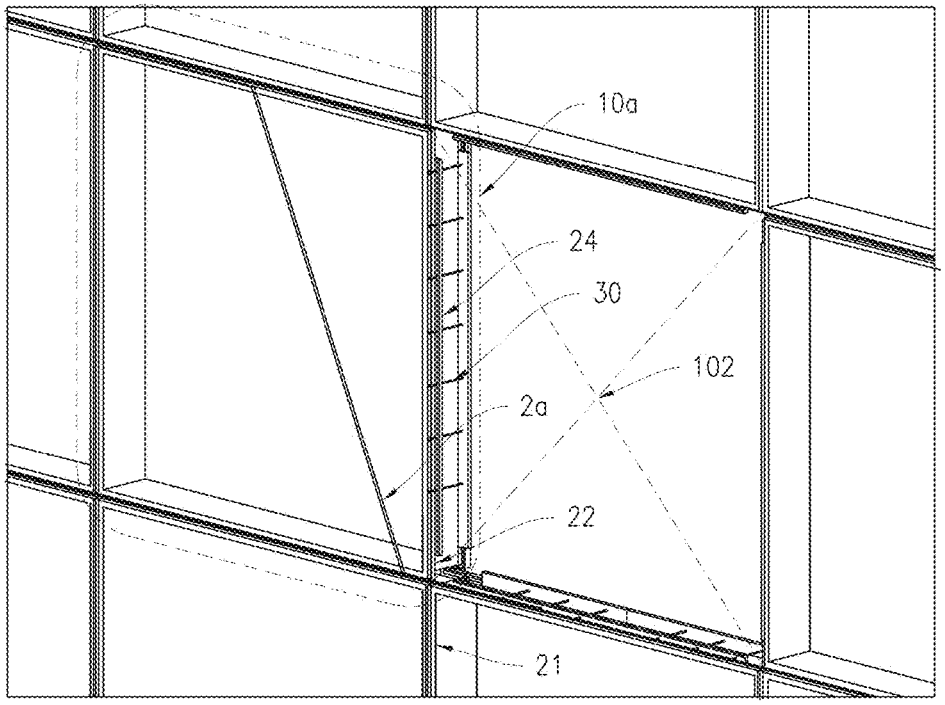
FIG. 2D is a perspective view of a window panel fastening assembly installed along a perimeter of a panel frame in accordance with an embodiment of the present invention.

With further reference to FIG. 2D, an installed panel 10*a* with interior sheet 2*a* (e.g., glass) is shown adjacent to wall opening 102. Wall opening 102 has installed along the perimeter thereof mullions 22, locking brackets 24 and rods 30. Sheets may be fixed to mullions 22. Gap 21 is shown to indicate the space between adjacent panels through which bolts may be inserted.

Figure 3:
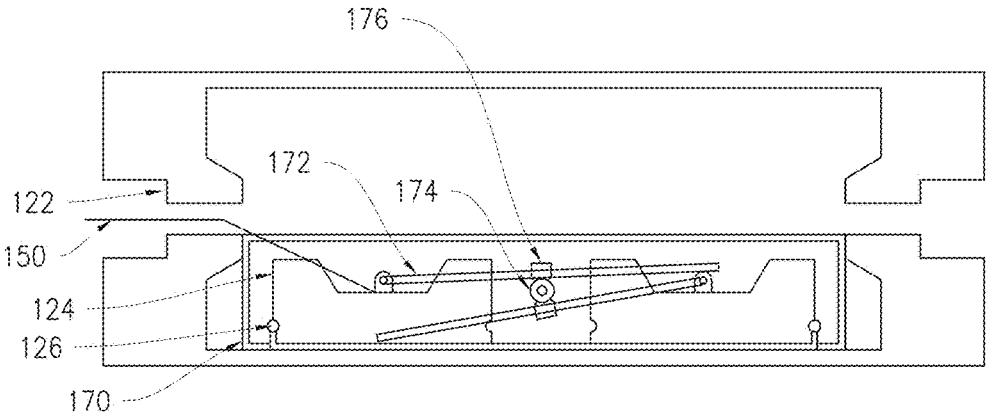
FIG. 3 is a sectional view of a window panel fastening assembly employing a cable-actuated locking device in a pre-installation position in accordance with an embodiment of the present invention.
Figure 3A:
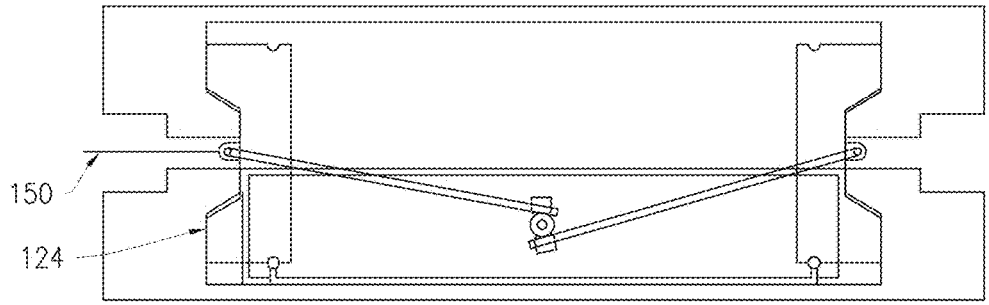
FIG. 3A is a sectional view of a window panel fastening assembly employing a cable-actuated locking device with locks positioned in an installation position in accordance with an embodiment of the present invention.

Now referring to FIG. 3, an embodiment of window panel fastening assembly includes mullions 122, locking brackets 124 pivotably mounted thereto via hinge 126 and a gear box 170 positioned within a mullion 124. A cable 150 is fixed at one end to one of the locking brackets. Gear bars 172 are pivotably mounted to a central region of each locking bracket 124 and coupled with a gear bar support 176 mounted to gear plate 174. As shown, the locking brackets are in a standby position. With further reference to FIG. 3A, applying pulling force on cable 150 in the direction indicated causes both locking brackets 124 to move into locking position with the mullions 122.

Figure 4:
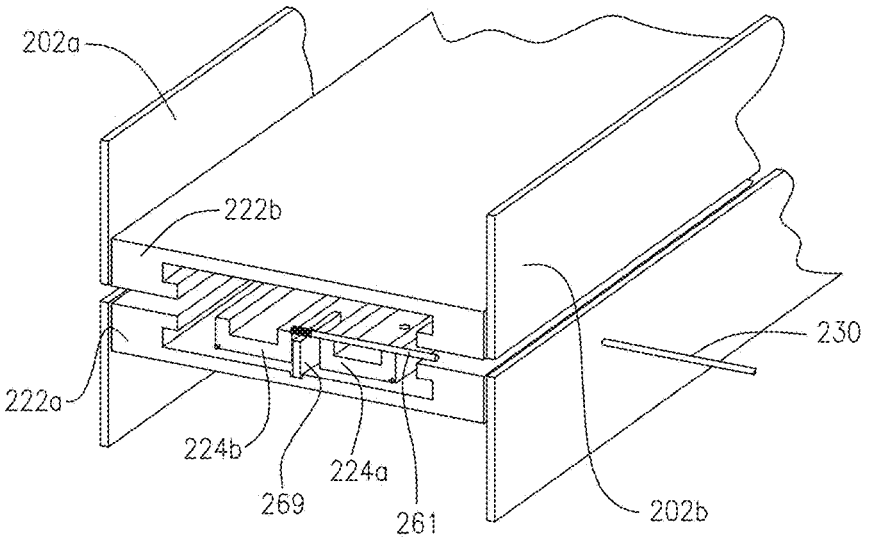
FIG. 4 is a perspective view of a window panel fastening assembly employing a rotating gear-actuated locking device in a pre-installation position in accordance with an embodiment of the present invention.
Figure 4A:
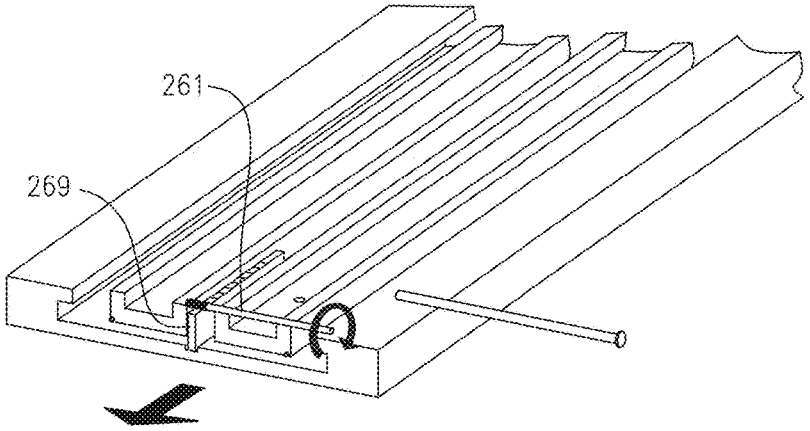
FIG. 4A is a perspective view of the window panel fastening assembly of FIG. 4 with the top mullion removed in accordance with an embodiment of the present invention.
Figure 4B:
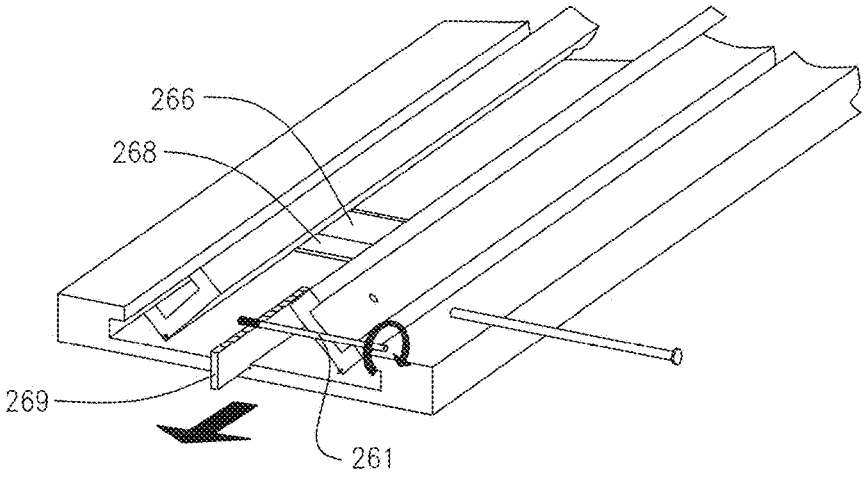
FIG. 4B is a perspective view of the window panel fastening assembly of FIG. 4A showing actuation of the rotating gear operating to raise the locks toward a locked position in accordance with an embodiment of the present invention.
Figure 4C:
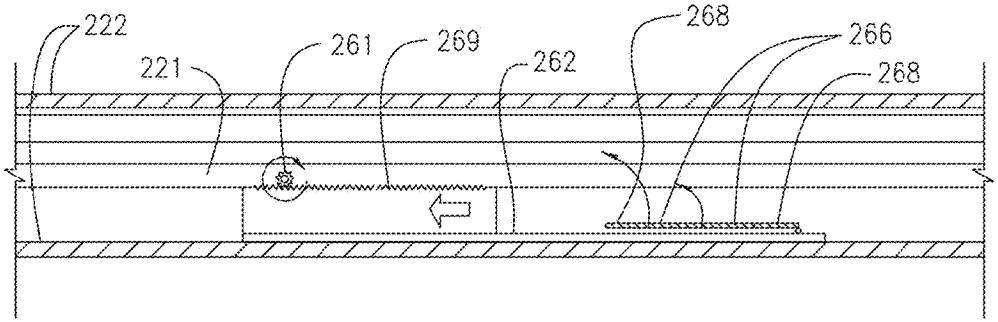
FIG. 4C is a longitudinal cross-sectional view of the window panel fastening assembly of FIG. 4A showing the direction of movement of the gear assembly in accordance with an embodiment of the present invention.
Figure 4D:
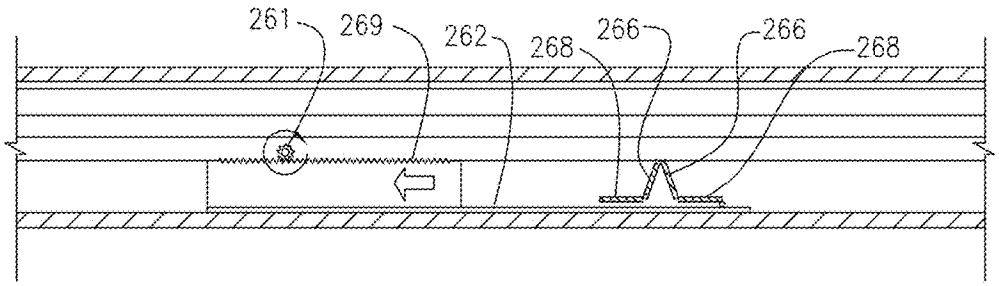
FIG. 4D is a longitudinal cross-sectional view of the window panel fastening assembly of FIG. 4B showing the latch in a semi-raised position which is operable to urge the locks in an upward direction in accordance with an embodiment of the present invention.
Figure 4E:
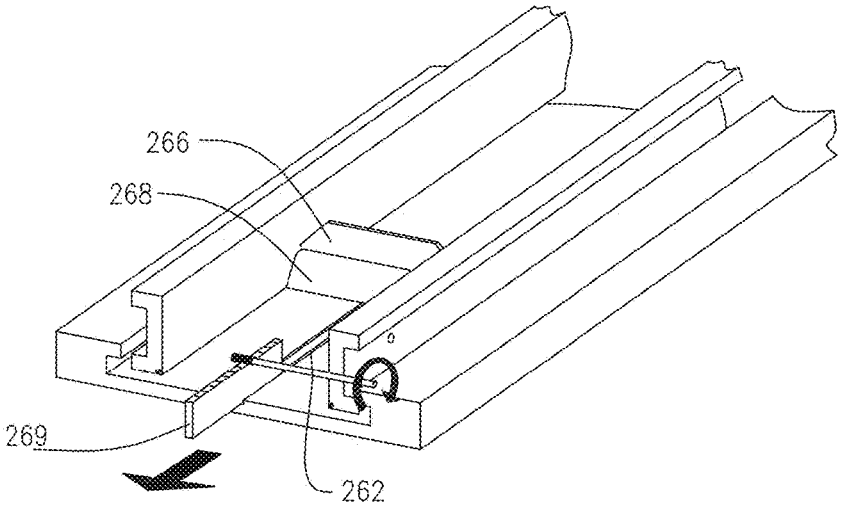
FIG. 4E is a perspective view of the window panel fastening assembly of FIG. 4A showing the latch in a semi-raised position and the locks raised to a position 90 degrees with respect to the mullion in accordance with an embodiment of the present invention.
Figure 4F:
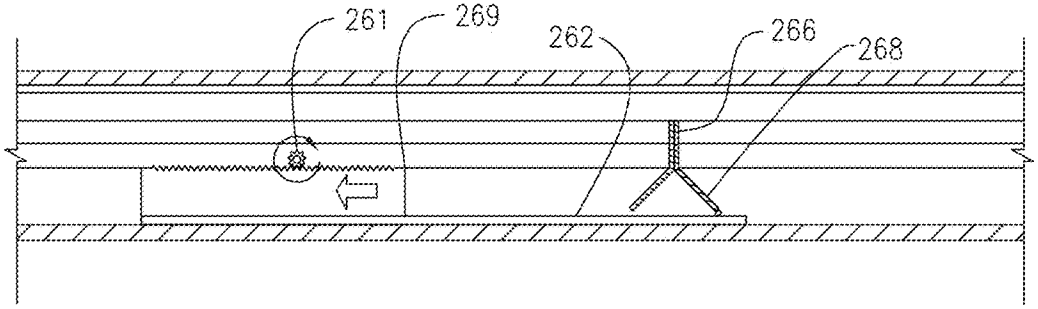
FIG. 4F is a longitudinal cross-sectional view of the window panel fastening assembly of FIG. 4E showing the latch in a semi-raised position in accordance with an embodiment of the present invention.
Figure 4G:
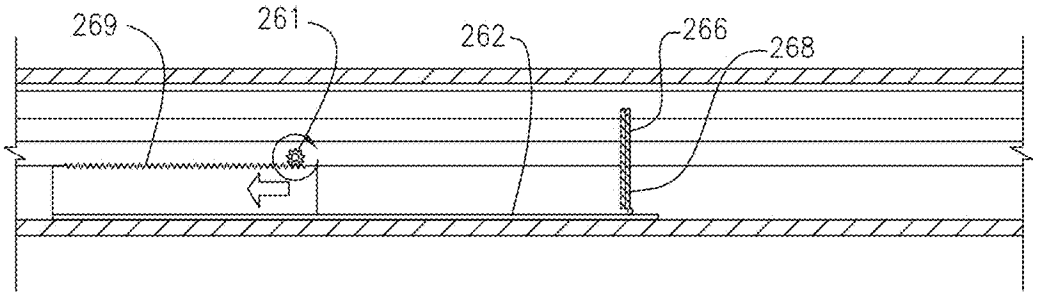
FIG. 4G is a longitudinal cross-sectional view of the window panel fastening assembly of FIG. 4H showing the latch in a fully raised position in accordance with an embodiment of the present invention.
Figure 4H:
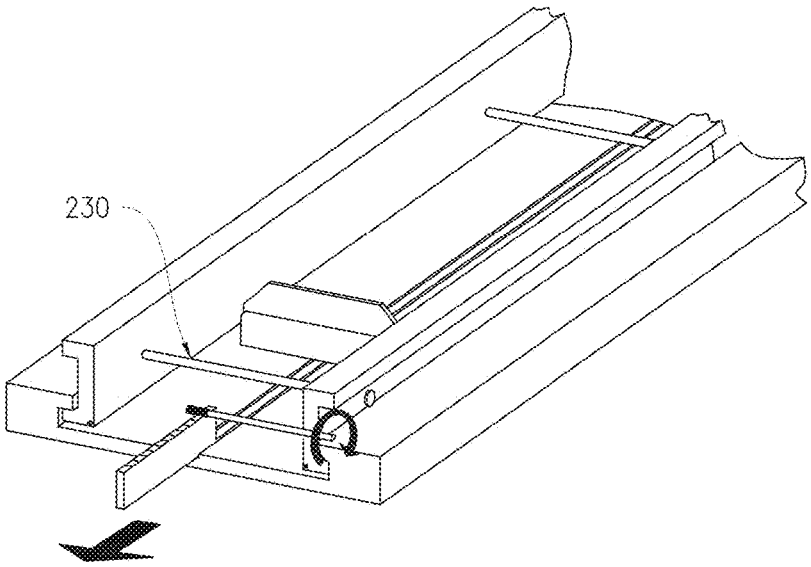
FIG. 4H is a perspective view of the window panel fastening assembly of FIG. 4A showing the latch in a fully raised position and the locks raised to a position 90 degrees with respect to the mullion and the locks engaged with the mullion in accordance with an embodiment of the present invention.

Now referring to FIG. 4, an embodiment of a window panel fastening assembly includes mullions 222*a* and 222*b* positioned opposite one another, locking brackets 224*a* and 224*b* disposed in a pre-installed state, a latching linear gear 269 movably mounted to an interior surface of mullion 222*a* and rotating gear 261 operably coupled to a gear surface of the latching linear gear 269. Sheets 202*a* and 202*b* are shown. Now with further reference to FIGS. 4A-4H, (FIGS. 4A, 4B, 4E and 4H are shown with mullion 222*b* removed for purposes of clarity), latching linear gear 269 is coupled to latching bar 262 which is in turn coupled to a plurality of hinged plates 266, 268. As the rotating gear 261 is rotated, latching linear gear 269 is moved along a longitudinal axis of the mullion 222*a*, exerting a pulling force on latching bar 262. As the latching bar 262 moves, it is operable to pull and raise the hinged plates 266, 268, operating to urge the locking brackets 224*a* and 224*b* upward. Hinged plates 266, 268 fold upon each other, ultimately forming a unitary latch oriented 90 degrees with respect to the base of the mullion 222*a* (FIGS. 4G, 4H). Bolt 230 secures the locking brackets 224*a*, 224*b* to the mullions 222*a* and 222*b*. The rotating gear 261 may be hand-rotated or rotated with a tool such as a screwdriver, wrench or the like in embodiments in which the gear 261 includes an end shaped or otherwise modified to receive the working end of such a tool.

Figure 5A:
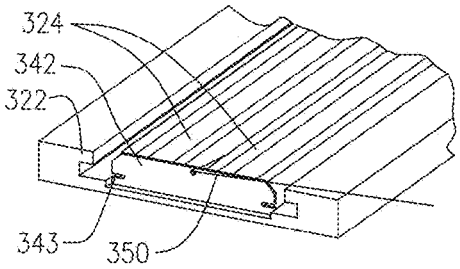
FIG. 5A is a perspective view of a window panel fastening assembly employing a cable-actuated locking device in a pre-installation position in accordance with an embodiment of the present invention.
Figure 5B:
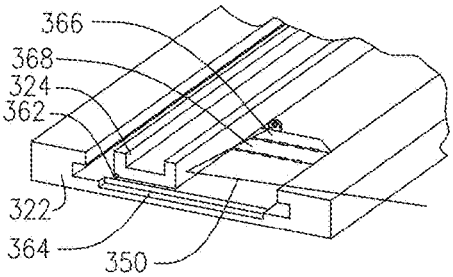
FIG. 5B is a perspective view with a partial cutaway of the window panel fastening assembly of FIG. 5A in a pre-installation position in accordance with an embodiment of the present invention.
Figure 5C:
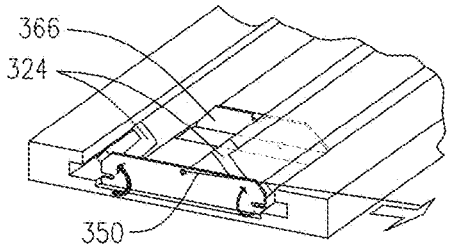
FIG. 5C is a perspective view of the window panel fastening assembly of FIG. 5A with latching device operably urging the locks toward an upright position in accordance with an embodiment of the present invention.
Figure 5D:
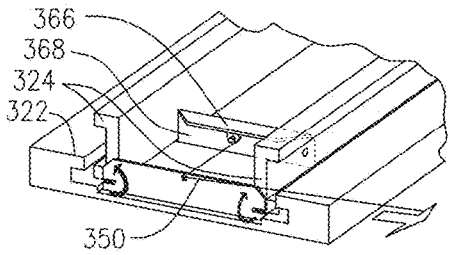
FIG. 5D is a perspective view of the window panel fastening assembly of FIG. 5A with latching device positioned in an upright position and the locks raised to a position 90 degrees with respect to the mullion in accordance with an embodiment of the present invention.
Figure 5E:
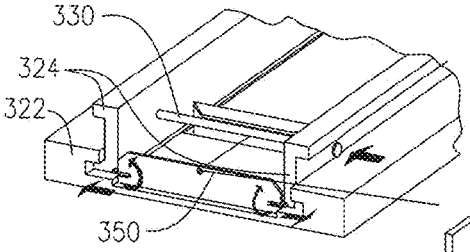
FIG. 5E is a perspective view of the window panel fastening assembly of FIG. 5A with the locks fastened with a bolt and the locks engaged with the mullion in accordance with an embodiment of the present invention.
Figure 5F:
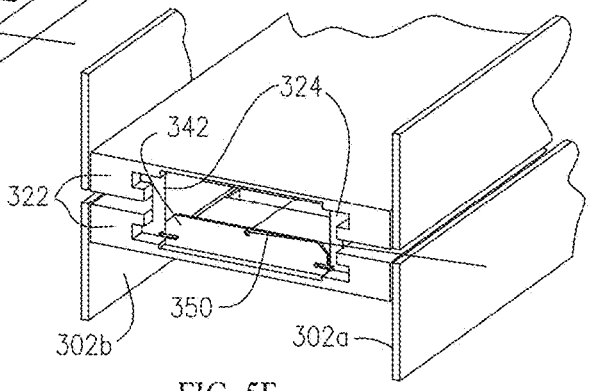
FIG. 5F is a perspective view of the window panel fastening assembly of FIG. 5A with window panels installed in accordance with an embodiment of the present invention.
Figure 6A:
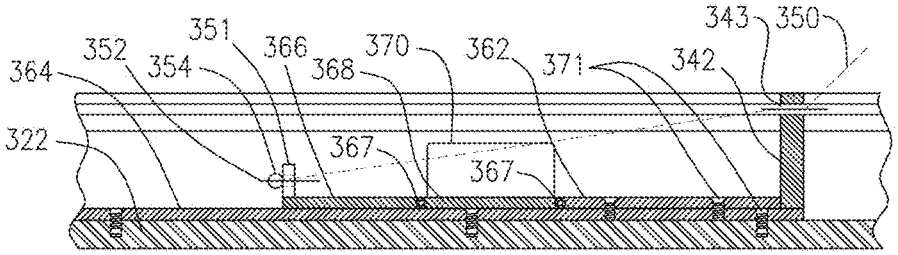
FIG. 6A is a longitudinal cross-sectional view of a window panel fastening assembly in accordance with FIG. 5A in a pre-installation position in accordance with an embodiment of the present invention.
Figure 6B:
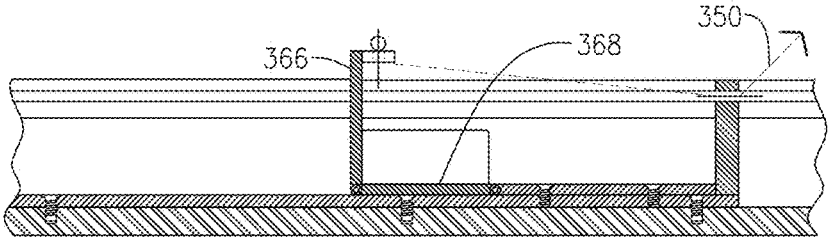
FIG. 6B is a longitudinal cross-sectional view of a window panel fastening assembly in accordance with FIG. 5A with the latch device operably moved by the cable to an intermediate position in accordance with an embodiment of the present invention.
Figure 6C:
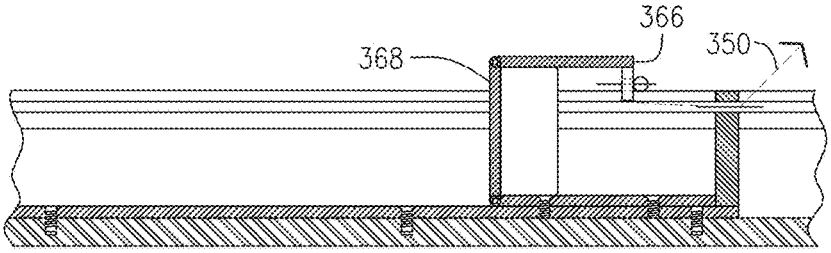
FIG. 6C is a longitudinal cross-sectional view of a window panel fastening assembly in accordance with FIG. 5A with the latch device operably moved by the cable to a fully engaged position in accordance with an embodiment of the present invention.

Now referring to FIGS. 5A-F and FIGS. 6A-6C, an embodiment of a window panel fastening assembly includes mullions 322, locking brackets 324 and a locking bracket housing wall 342. Locking brackets 324 include hinge pins 362 operably engaged in slots 342 formed in locking bracket housing wall 342. Locking bracket housing wall includes an aperture for a cable 350 which is connected at one end to a folding plate 366 such as via a connector 351 such as but not limited to a cable hook having an opening 352. Cable may include a cable lock 354 fixed to an end to engage the connector 351. Plate 366 is hingedly coupled to folding plate 368, which in turn is hingedly connected to fixed plate 362. Fixed plate 362 is fixed to a latch housing base 364 such as via screws 371. Latch housing base is fixed to mullion 322. A block 370 is coupled to plate 368. With reference to 5C-5E and 6B-6C, as a pulling force is exerted on cable 350, cable 350 lifts folding plate 366 upward to contact block 370, driving locking brackets 324 in an upward direction. Continued pulling force on the cable 350 causes folding plate 366 to continue in a direction along a longitudinal axis of the mullions 322 and causes folding plate 368 to be lifted upward and in the same direction, continuing to drive the locking brackets 324 upward until they stand at 90 degrees and in line with the mullion grooves. Block 370 maintains the folding plates 366, 368 in a blocked configuration, preventing the plates from folding on each other. Bolt 330 secures the locking brackets 324 to the mullions 322 as best seen in FIG. 5F.

It will be apparent to the skilled artisan that the latching mechanisms of one or more embodiments of the present invention may be attached to the mullion with a gasket that allows for thermal expansion. The latching mechanism may be housed within a housing coupled to the mullion to maintain clearances during installation.

Figure 7A:
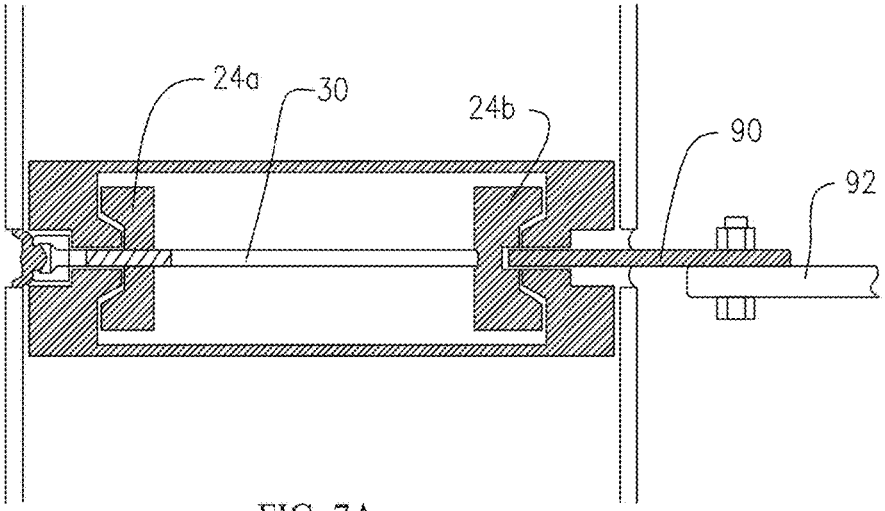
FIG. 7A is a sectional view of a window panel fastening assembly with a mounting plate coupled with a structural member in accordance with an embodiment of the present invention.
Figure 7B:
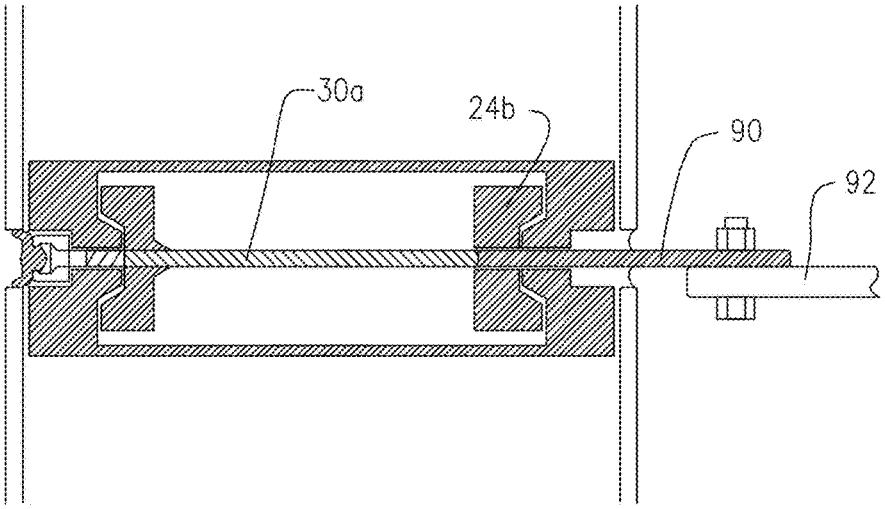
FIG. 7B is a sectional view of a window panel fastening assembly with a mounting plate coupled with a structural member in accordance with an embodiment of the present invention.

Now referring to FIG. 7A, an embodiment of a window panel fastening assembly may include a lateral bracing plate 90 extending between adjacent panels, providing a means to attach the assembly to a structural member 92. Referring to FIG. 7B, the bolt 30*a* may be a combined fixed lock and lateral brace.

Figure 8:
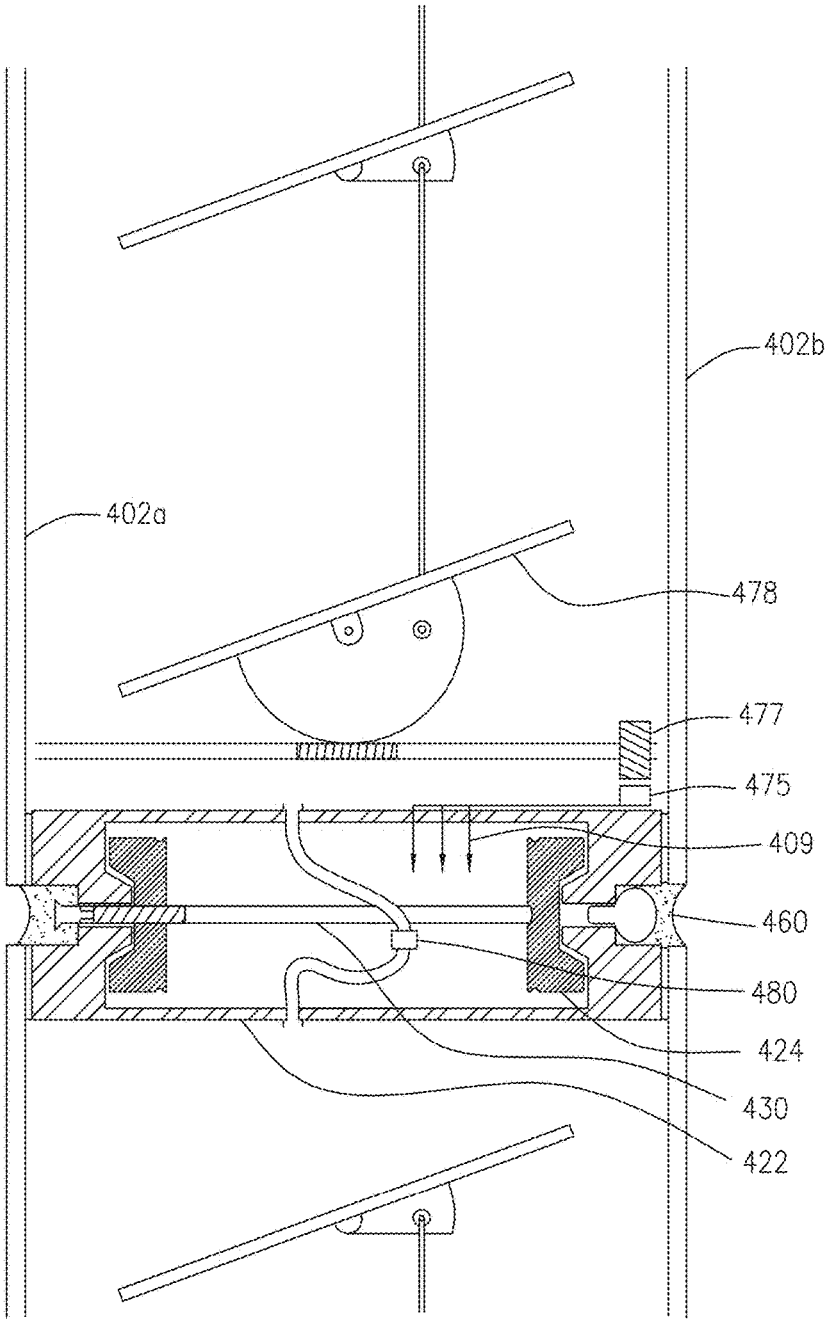
FIG. 8 is a sectional view of a window panel fastening assembly with an air duct disposed therein and a movable louver assembly disposed between sheets of glass or other material in accordance with an embodiment of the present invention.

Now referring to FIG. 8 in a further embodiment a window panel fastening assembly with a panel, and chamber, formed by interior glazing sheet 402*a* and exterior glazing sheet 402*b* may include a mullion 422 including one or more conduits 480 such as air ducts, tubes or hoses disposed therein, allowing for air and gas transport between adjacent panels. The conduits are 480 operable to, inter alia, maintain positive pressure and allow the movement of gases to heighten environmental or aesthetic performance. Various gases can be charged into the chambers, and exchanged, to modify color and transparency levels of panels, providing visual effects and/or privacy as needed. The conduits may be equipped with valves that may be operated by remote control.

The large space in the chamber between window panels provides sufficient room to accommodate a shading device, which can be remotely controlled. Since the shading device is inside the chamber, it is protected from outside factors. Thus, for example, the chamber may include one or more louvers 478 mounted therein, operably connected to a control gear 477 and a motor or magnetic device with a coupling 409 for one or more of a power, control and/or sensor device. One or more photovoltaic cells may be coupled with the louvers 478 to provide power without a connection to an outside power source. The louvers 478 may be operated remotely to provide shade, privacy, decorative appearance, etc.

Figure 9A:
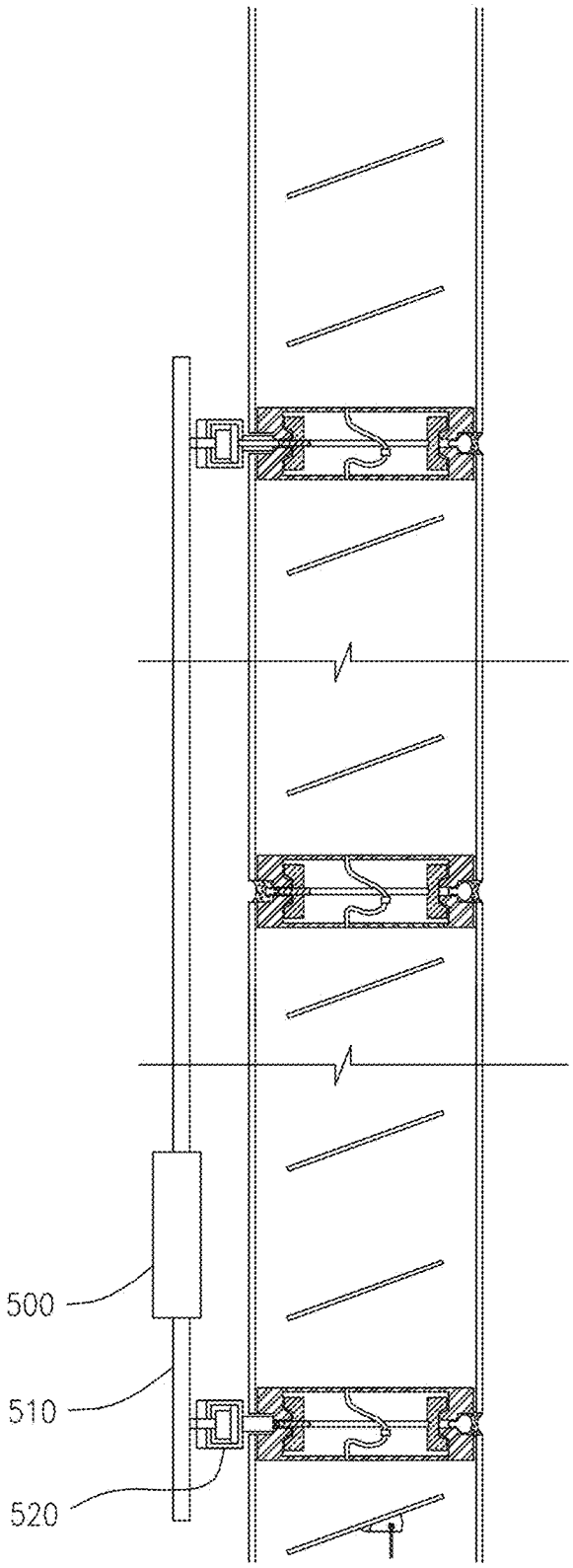
FIG. 9A is a sectional view of window panel fastening assemblies and a window cleaning apparatus coupled thereto in accordance with an embodiment of the present invention.
Figure 9B:
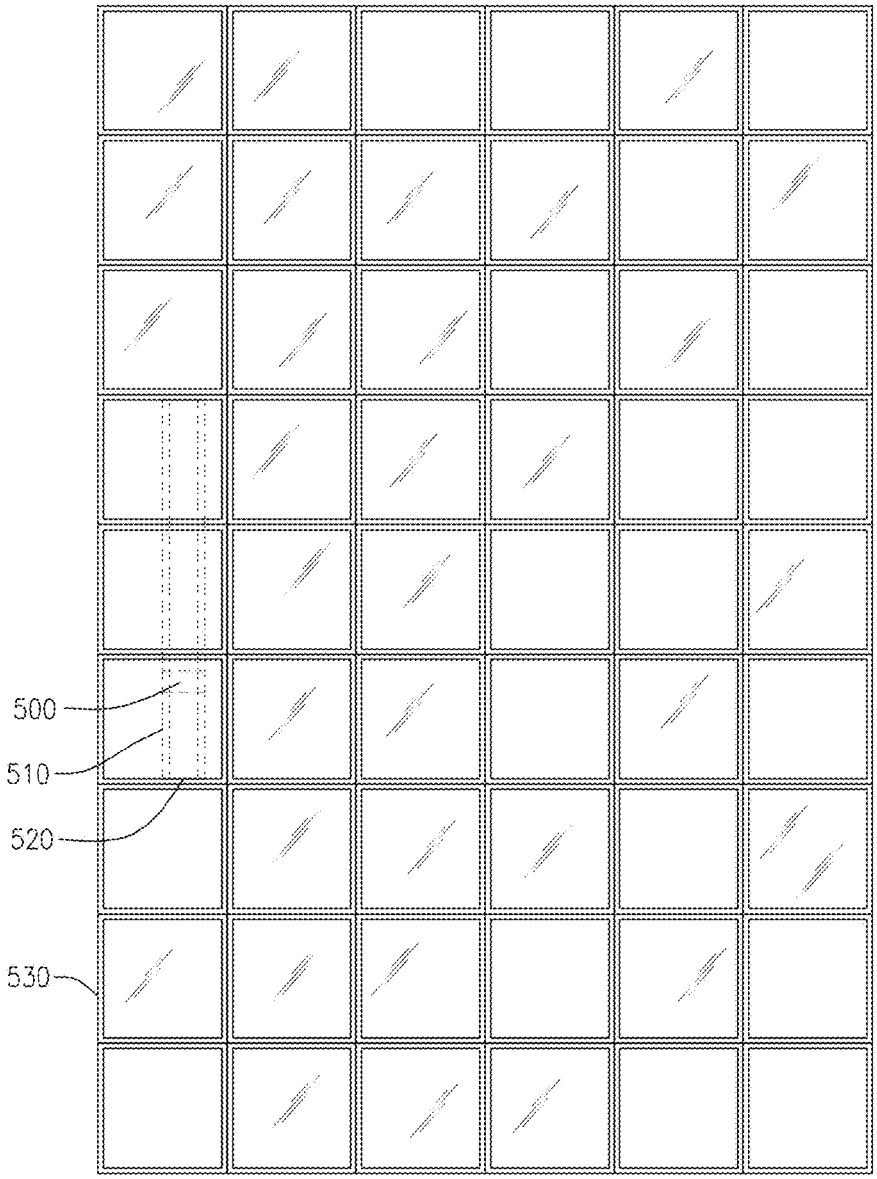
FIG. 9B is a front view of multiple window panels and a window cleaning apparatus coupled thereto in accordance with an embodiment of the present invention.
Figure 10A:
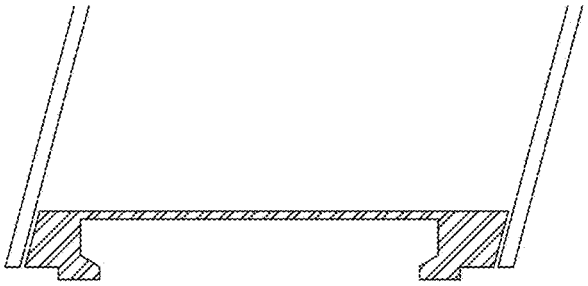
FIG. 10A is a sectional view of a 15 degree mullion in accordance with an embodiment of the present invention.
Figure 10B:
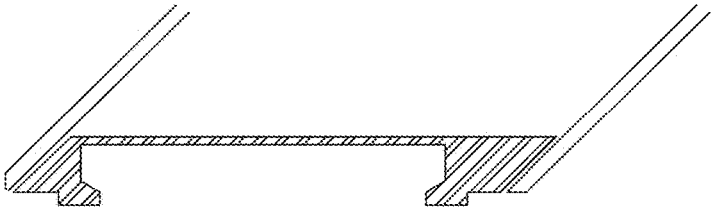
FIG. 10B is a sectional view of a 45 degree mullion in accordance with an embodiment of the present invention.
Figure 10C:
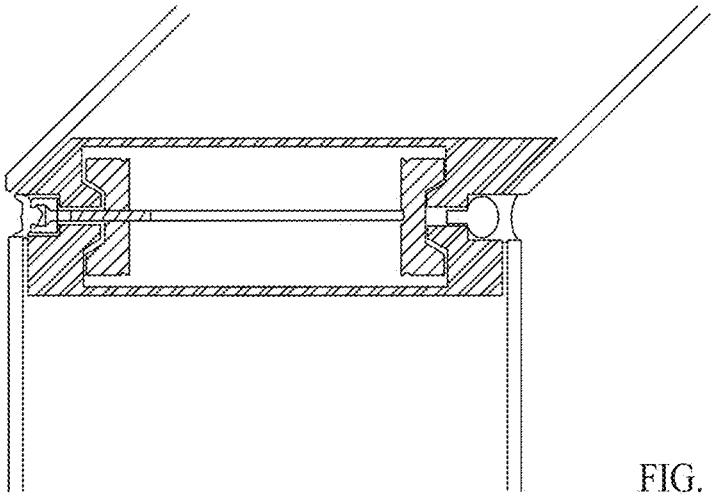
FIG. 10C is a sectional view of a window panel fastening assembly employing a 135 degree mullion assembly in accordance with an embodiment of the present invention.
Figure 10D:
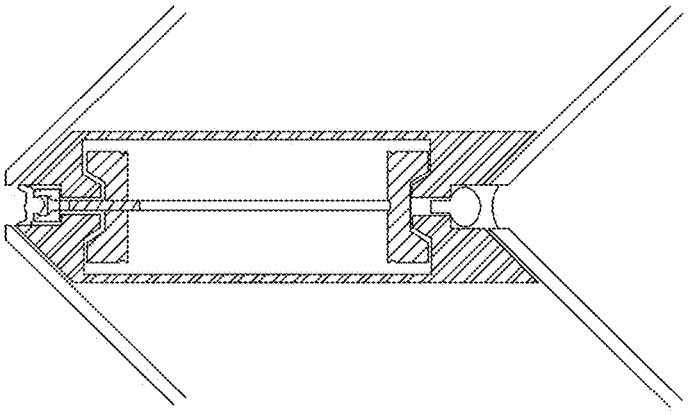
FIG. 10D is a sectional view of a window panel fastening assembly employing a 90 degree mullion assembly in accordance with an embodiment of the present invention.
Figure 10E:
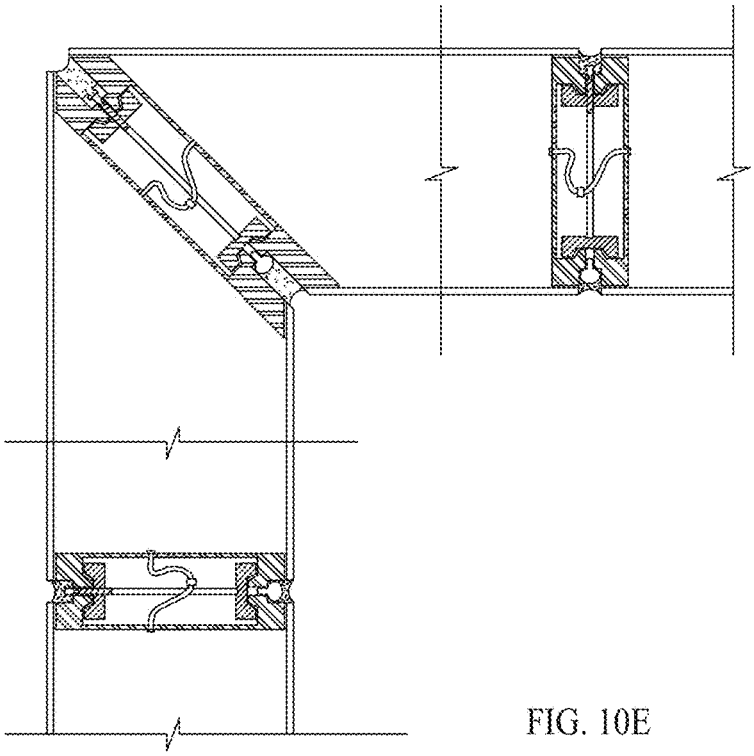
FIG. 10E is a sectional view of adjacent window panels with a fastening assembly employing a 90 degree mullion assembly in accordance with an embodiment of the present invention.
Figure 10F:
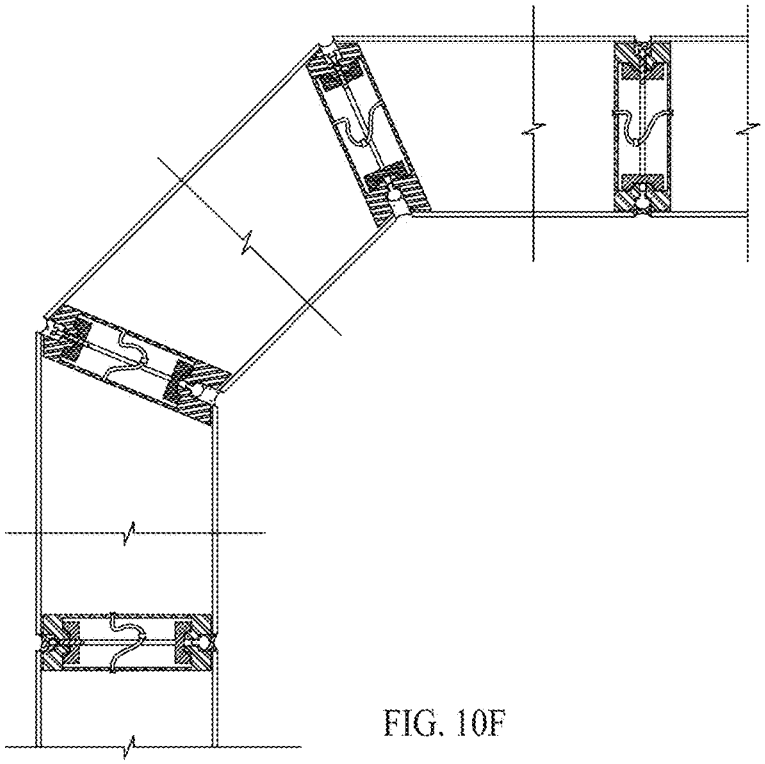
FIG. 10F is a sectional view of adjacent window panels with a fastening assembly employing a 135 degree mullion assembly in accordance with an embodiment of the present invention.
Figure 11:
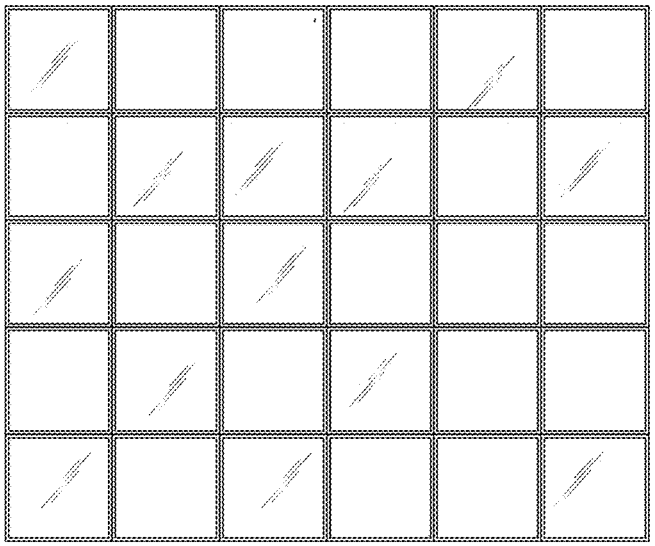
FIG. 11 is a front view of a multi-panel assembly in accordance with an embodiment of the present invention.
Figure 12:
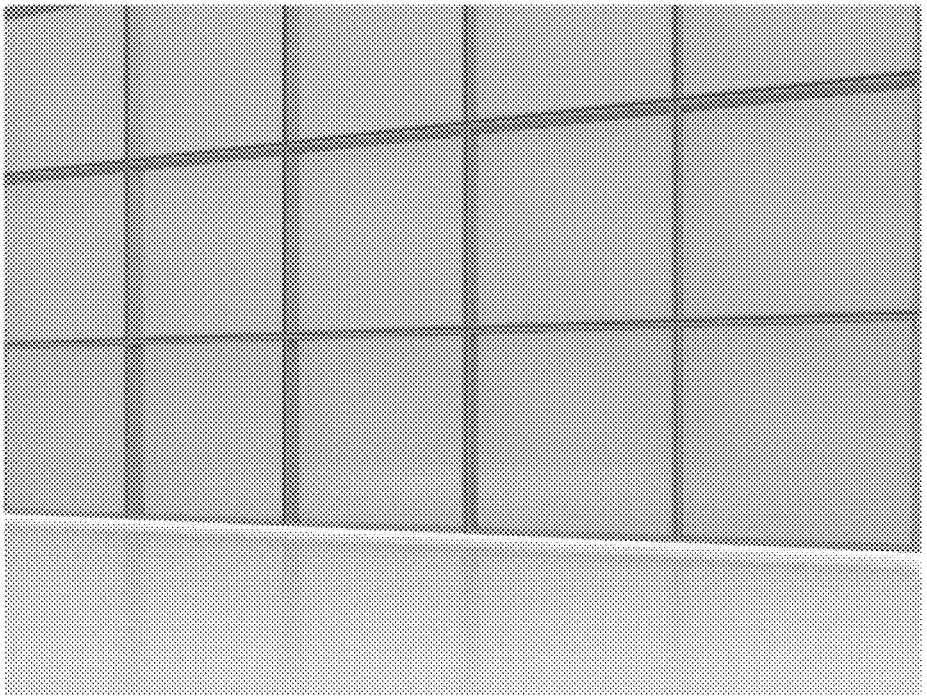
FIG. 12 is a perspective view of a multi-panel assembly in accordance with an embodiment of the present invention.
Figure 13:
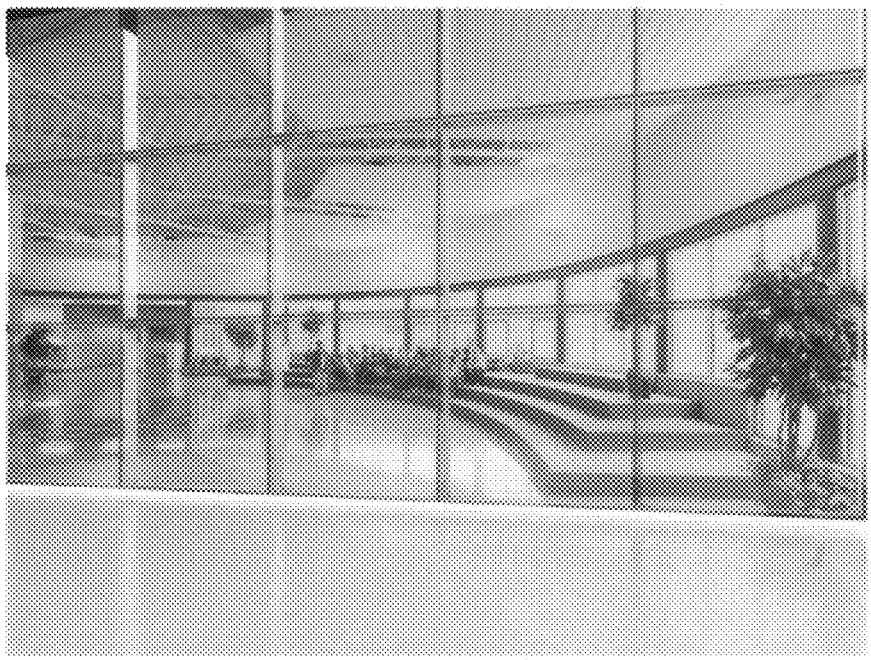
FIG. 13 is a perspective view of a multi-panel assembly in accordance with an embodiment of the present invention.
Figure 14:
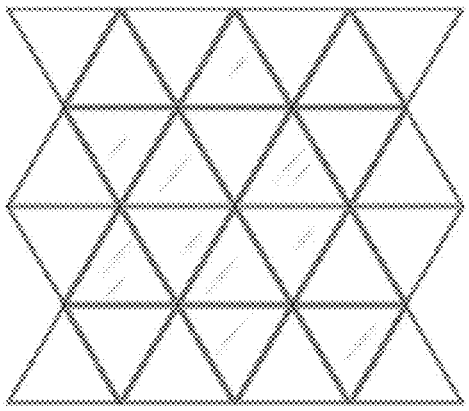
FIG. 14 is a front view of a multi-panel assembly in accordance with an embodiment of the present invention.

Now referring to FIGS. 9A and 9B, in a further embodiment a fastening assembly including one or more fixed horizontal tracks 520 and/or vertical tracks 530 coupled to a fastening assembly disclosed herein, such as one including one or more lateral bracing plates 90 described above with respect to FIGS. 7A and 7B, and a window cleaning apparatus having a cleaning track 510 and a cleaning device 500. The cleaning track 510 is operable to move along tracks 520 and/or 530, and the window cleaning device 500 may be operable to move along the length of the cleaning track. The flush surface of multiple embodiments of the present invention facilitates mechanical cleaning of the window panels. Therefore, a cleaning device such as device 500 can be fixed on the vertical or horizontal track 520 and/or 530, and does not encounter extrusions such as mullions, since the mullions are inside the chamber.

With reference to FIGS. 10A-F, non-limiting examples of configurations of mullions and window fastening assemblies as disclosed herein include 15, 45, 135 and 90 degree configurations operable to be employed with various buildings and window panel assemblies. It will be apparent to the skilled artisan that the mullions and window fastening assemblies disclosed herein may be modified to suit particular applications.

Figure 15:
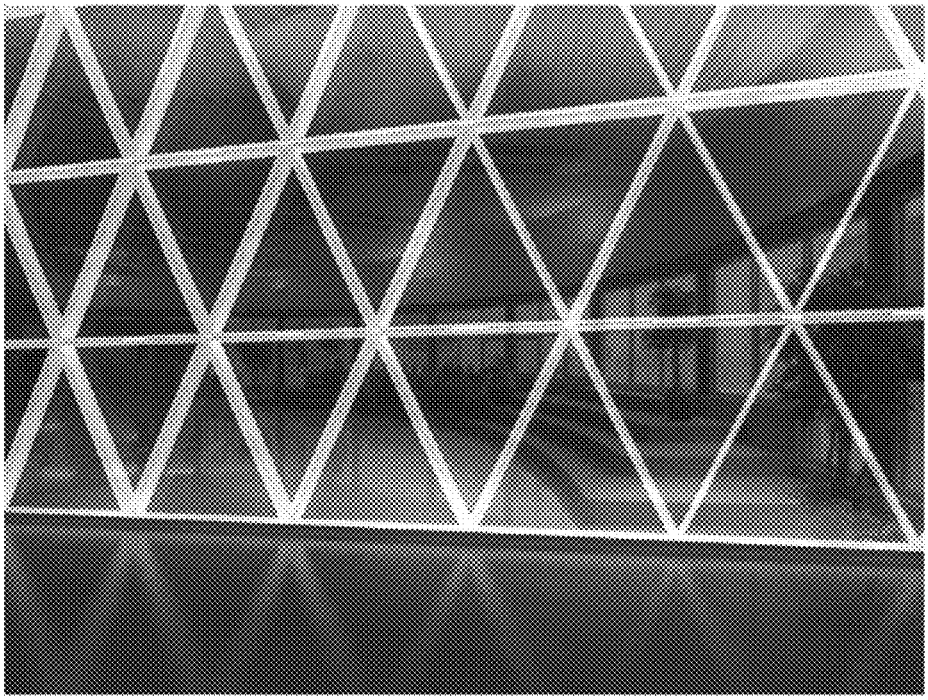
FIG. 15 is a perspective view of a multi-panel assembly using glowable clear polyvinyl in accordance with an embodiment of the present invention.

Now referring to FIGS. 11-15, various embodiments of multi-panel assemblies are shown in accordance with embodiments of the present invention. Films of various thicknesses and materials may be employed in the chamber of the wall panels disclosed herein. For example, embodiments of the present invention may include clear polyvinyl, which can glow, allowing for an aesthetically pleasing view, both inside and outside. In FIG. 15 the multi-panel assembly employs glowable clear polyvinyl for aesthetic effect.

In terms of installation, once the fastener assemblies are locked in place, any connecting tubes are secured and tucked away prior to caulking. Both interior and exterior gaps are caulked using a backer rod or similar device.

Although the systems and methods of the present disclosure have been described with reference to exemplary embodiments thereof, the present disclosure is not limited thereby. Indeed, the exemplary embodiments are implementations of the disclosed systems and methods are provided for illustrative and non-limitative purposes. Changes, modifications, enhancements and/or refinements to the disclosed systems and methods may be made without departing from the spirit or scope of the present disclosure. Accordingly, such changes, modifications, enhancements and/or refinements are encompassed within the scope of the present invention.

What is claimed is:

1. A window panel fastening assembly comprising a first and second mullion, each mullion comprising opposing mounting surfaces configured to be mounted to sheets of material, an air chamber-facing surface and an open side opposite the air chamber-facing surface, and opposing grooves disposed therein, wherein the first and second mullions are positioned with open sides facing each other; first and second locking brackets coupled to the grooves of the first and second mullions, wherein at least one of the first and second locking brackets is pivotably coupled to an interior surface of one of the first and second mullions, a rod positionable between the locking brackets, a gear box positioned within the first mullion, a cable fixed at one end to one of the locking brackets, and a first and second gear bar pivotably mounted to a central region of each locking bracket and coupled with a gear bar support mounted to a gear plate, wherein application of a pulling force on the cable is operable to engage the locking brackets with the grooves of the first and second mullions and wherein the window panel fastening assembly is operable to fasten adjacent panels to each other.

2. The invention of claim 1 wherein the locking brackets have a generally U-shaped cross section.

3. The invention according to claim 1 wherein at least one of the locking brackets comprises a bore for receiving the rod.

4. The invention according to claim 1 wherein the rod is positionable in a space formed between the first and second mullions.

5. The invention according to claim 1 further comprising a brace positioned between the first and second mullions wherein the brace is operable to guide and secure the rod and the structural integrity between the first and second mullions.

6. The invention according to claim 5 further comprising a backer rod positioned opposite the brace.

7. The invention according to claim 1 wherein at least one of the locking brackets comprises a threaded bore for receiving the rod, wherein the rod includes a threaded region complementary to the threaded bore, wherein advancement of the rod through the locking bracket is operable to urge the first and second locking brackets in the grooves.

8. The invention according to claim 1 wherein both the first and second locking brackets are pivotably coupled to the first mullion.

9. The invention according to claim 1 further comprising a lateral bracing plate positioned between the first and second mullions and extending therefrom to an exterior of the window panel fastening assembly.

10. A window panel assembly comprising a first and second sheet of material positioned in axial alignment, each sheet having a perimeter and number of sides identical to the other sheet, and a plurality of window panel fastening assemblies of claim 1 coupled along the respective perimeters of the first and second sheets, wherein the first sheet is coupled to the first mounting surface of each of the first mullions of the window fastening assemblies and wherein the second sheet is coupled to the second, opposing mounting surface of each of the first mullions, the first and second sheets and the first mullions of the plurality of window panel fastening assemblies defining an air chamber.

11. The invention according to claim 10 further comprising a conduit disposed in at least one of the mullions, the conduit open at one end to the air chamber.

12. The invention according to claim 10 further comprising a shading device positioned in the air chamber.

13. The invention according to claim 12 wherein the shading device comprises one or more louvers.

14. The invention according to claim 10 further comprising at least one adjacent window panel assembly.

15. The invention according to claim 10 comprising at least one insulation film disposed in the air chamber.

16. A window panel assembly comprising an air chamber defined by two opposing sheets of material and a plurality of window panel fastening assemblies according to claim 1 disposed along the perimeter and between the two opposing sheets of material.

17. A window wall comprising a plurality of window panel assemblies according to claim 16, each of the plurality of window panel assemblies coupled to an adjoining window panel assembly by a concealed window panel fastening assembly.

18. A window wall according to claim 17 comprising at least one vertical track and/or horizontal track coupled to the window panel fastening assembly.

19. A window panel fastening assembly comprising a first and second mullion, each mullion comprising opposing mounting surfaces configured to be mounted to sheets of material, an air chamber-facing surface and an open side opposite the air chamber-facing surface, and opposing grooves disposed therein, wherein the first and second mullions are positioned with open sides facing each other; first and second locking brackets coupled to the grooves of the first and second mullions, wherein at least one of the first and second locking brackets is pivotably coupled to an interior surface of one of the first and second mullions, a rod positionable between the locking brackets, a latching linear gear movably coupled to an interior surface of the first mullion and rotating gear operably coupled to a gear surface of the latching linear gear, wherein the latching linear gear is coupled to a latching bar, which is in turn coupled to a plurality of hinged plates positioned between an interior surface of the first mullion and the locking brackets, wherein the rotating gear is operable to move the latching linear gear along a longitudinal axis of the first mullion, exerting a pulling force on the latching bar, wherein movement of the latching bar is operable to pull and raise the hinged plates, which raising is operable to urge the locking brackets toward engagement with the grooves of the first and second mullion.

20. The invention according to claim 19 wherein the hinged plates are operable to fold upon each other to form a unitary latch oriented 90 degrees with respect to the first and second mullions.

21. A window panel assembly comprising a first and second sheet of material positioned in axial alignment, each sheet having a perimeter and number of sides identical to the other sheet, and a plurality of window panel fastening assemblies of claim 19 coupled along the respective perimeters of the first and second sheets, wherein the first sheet is coupled to the first mounting surface of each of the first mullions of the window fastening assemblies and wherein the second sheet is coupled to the second, opposing mounting surface of each of the first mullions, the first and second sheets and the first mullions of the plurality of window panel fastening assemblies defining an air chamber.

22. A window panel assembly comprising an air chamber defined by two opposing sheets of material and a plurality of window panel fastening assemblies according to claim 19 disposed along the perimeter and between the two opposing sheets of material.

23. A window panel fastening assembly comprising a first and second mullion, each mullion comprising opposing mounting surfaces configured to be mounted to sheets of material, an air chamber-facing surface and an open side opposite the air chamber-facing surface, and opposing grooves disposed therein, wherein the first and second mullions are positioned with open sides facing each other; first and second locking brackets coupled to the grooves of the first and second mullions, wherein at least one of the first and second locking brackets is pivotably coupled to an interior surface of one of the first and second mullions, a rod positionable between the locking brackets, a locking bracket housing wall comprising an aperture for a cable, wherein the cable is connected at one end to a first folding plate, wherein the first folding plate is hingedly coupled to a second folding plate, which in turn is hingedly connected to a fixed plate coupled to a latch housing base coupled to the first mullion, and further comprising a block coupled to the second folding plate, wherein the first and second folding plates are positioned between an interior surface of the first mullion and the locking brackets, wherein a pulling force exerted on the cable is operable to lift the first plate to contact the block, which movement is operable to drive the locking brackets in an upward direction.

24. The invention according to claim 23 wherein the pulling force exerted on the cable is operable to lift the second folding plate upward and drive the locking brackets toward engagement with the grooves of the first and second mullions.

25. A window panel assembly comprising a first and second sheet of material positioned in axial alignment, each sheet having a perimeter and number of sides identical to the other sheet, and a plurality of window panel fastening assemblies of claim 23 coupled along the respective perimeters of the first and second sheets, wherein the first sheet is coupled to the first mounting surface of each of the first mullions of the window fastening assemblies and wherein the second sheet is coupled to the second, opposing mounting surface of each of the first mullions, the first and second sheets and the first mullions of the plurality of window panel fastening assemblies defining an air chamber.

26. A window panel assembly comprising an air chamber defined by two opposing sheets of material and a plurality of window panel fastening assemblies according to claim 23 disposed along the perimeter and between the two opposing sheets of material.

* * * * *